United States Patent [19]

Lemaire et al.

[11] Patent Number: 4,852,745

[45] Date of Patent: Aug. 1, 1989

[54] APPARATUS FOR AUTOMATICALLY ELIMINATING A GROUP OF ARTICLES TO BE TREATED OF WHICH AT LEAST ONE IS MISSING OR DEFECTIVE

[75] Inventors: Didier Lemaire, Cherisy; Jean-Marc Dronet, Putanges Pont Ecrepin, both of France

[73] Assignee: E. P. Remy & Cie., France

[21] Appl. No.: 182,914

[22] Filed: Apr. 18, 1988

[30] Foreign Application Priority Data

Apr. 24, 1987 [FR] France ..... 87 05846

[51] Int. Cl.[4] ..... B07C 5/342

[52] U.S. Cl. ..... 209/588; 73/831; 73/665; 91/217; 209/653; 209/912; 209/933; 209/934; 209/936; 414/788.7; 414/795.6

[58] Field of Search ..... 209/524, 588, 653, 912, 209/934, 936, 933; 414/30, 32, 96, 115, 78.2, 788.7, 795.6, 797.8; 73/25, 665 F, 831; 91/217

[56] References Cited

U.S. PATENT DOCUMENTS

| | | | |
|---|---|---|---|
| 3,411,621 | 11/1968 | Gerben | 209/72 |
| 3,534,525 | 10/1970 | Cleland | 414/96 X |
| 3,773,172 | 11/1973 | McClure et al. | 209/588 X |
| 4,390,098 | 6/1983 | Wilgus et al. | 209/653 X |
| 4,640,116 | 2/1987 | Brown | 72/356 |

FOREIGN PATENT DOCUMENTS 2225201 12/1973 Fed. Rep. of Germany .

*Primary Examiner*—Robert J. Spar
*Assistant Examiner*—Janice Krizek
*Attorney, Agent, or Firm*—Steinberg & Raskin

[57] ABSTRACT

The present invention concerns an apparatus for automatically eliminating a group of articles to be treated of which at least one is missing or defective in this group, this apparatus comprising essentially a detecting cell located above the articles or containers transported by a conveyor, a magazine for storing these containers located near the detecting cell, and pushers arranged vertically under the magazine and under the containers transported by the conveyor.

1 Claim, 1 Drawing Sheet

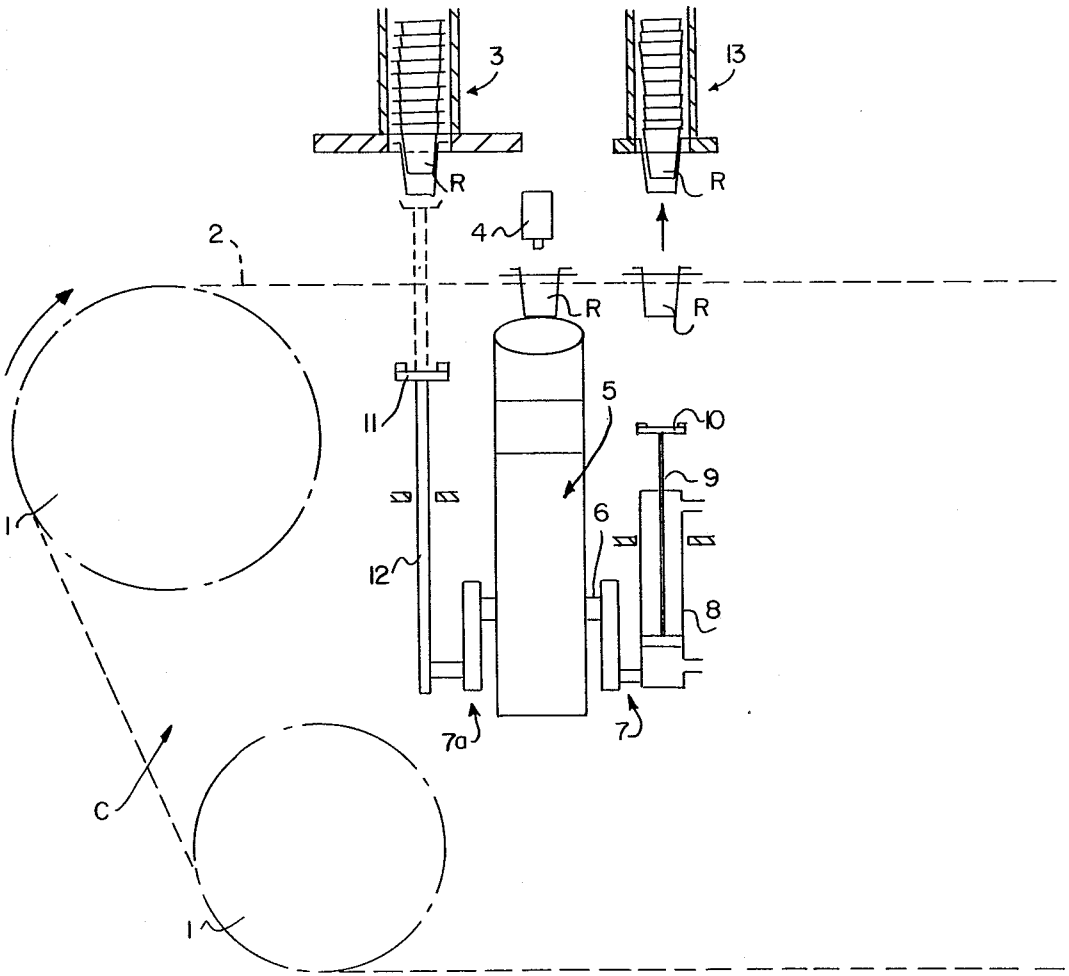
13
R
R
R
R
3
4
5
6
7
7a
8
9
10
11
12
2
1
1
C

APPARATUS FOR AUTOMATICALLY ELIMINATING A GROUP OF ARTICLES TO BE TREATED OF WHICH AT LEAST ONE IS MISSING OR DEFECTIVE

BACKGROUND OF THE INVENTION

The present invention has essentially as an object an apparatus for automatically eliminating a group of articles, such for example as containers or goblets, of which at least one is missing or defective in said group.

Machines for automatically processing containers or goblets comprising one conveyor with two endless chains or the like between which are mounted supports intended to receive containers to be processed have existd for a long time. Above the conveyor are disposed various successive stations which permit the containers to be processed, such as for example one station for taking the containers out of piles and for depositing the containers onto the conveyor, one station for filling the containers and one station for closing the containers through heat sealing of a lid for example.

However, problems often arise when the containers or goblets are taken out of piles and are deposited on the conveyor. Indeed, it sometimes happens that the operation of taking the containers out of piles does not proceed properly, so that the conveyor receives two or more goblets which are piled up and stuck in each other. It happens also that one of the goblets is missing or is defective in the row of goblets deposited on the conveyor.

Therefore, if such a breakdown appears, the processes the containers are to undergo thereafter disturb the operation of the machine and the processing. Indeed, if a goblet is missing, the filling will be performed directly on the conveyor, which is likely to damage it, to say nothing of the smears which will result therefrom. The same kind of drawbacks will be encountered if the goblet is perforated, deformed or defective. Besides, if several goblets are stuck in one another, catchings and ruptures of the goblets will appear at the closing station, i.e. when the goblet will be urged against a heat sealing head.

It is therefore advisable, when a defect appears on a row or on a group of goblets deposited on the conveyor before being filled, to eliminate this group or this row of goblets totally to avoid a disturbance of the operation of the machine. However, until now, no system has been proposed for this purpose.

SUMMARY OF THE INVENTION

Therefore, the present invention has as an object to fill this gap by proposing an apparatus for automatically eliminating a group of containers, the mechanical design of this apparatus being simple and reliable concerning the operation thereof.

For this purpose, the invention has as an object the automatic elimination of a group of articles, such for example as containers or goblets of which at least one is missing or defective in this group, said group belonging to several groups of articles or containers transported one after another by a conveyor or the like to undergo various operations. The defect or the lack of at least one article or container inside one group of articles transported by the conveyor once detected, the whole group of articles is pushed through this conveyor and is stored inside a magazine above the conveyor for possibly recycling thereafter the non-defective articles of the said group.

This invention concerns more particularly an apparatus characterized in that it comprises at least one detecting means, such for example as a cell, located above the articles or containers to be transported by a conveyor or the like, one container storing magazine located near the detecting means and pushers arranged vertically under said magazine under the articles or containers transported by the conveyor.

This apparatus is also characterized in that the aforesaid pushers consist of the rods of cylinders which are actuatable by the detecting means and whose body is connected to the output shaft of a reducer through a connecting rod-crank system.

It is also to be precised that the output shaft of the reducer is also connected, through another connecting rod-crank system, to pushing rods likely to pass through the carrying run of the conveyor to deposit the articles or containers coming from a station for taking the containers out of piles, on this conveyor.

The invention concerns also a processing machine comprising at least one conveyor with endless chains or the like which permits transporting containers, such for example as goblets which pass under a succession of stations for example for taking the containers out of piles, for filling and for closing the containers, characterized in that it comprises one apparatus presenting the above features and located near the station for taking the containers out of piles.

BRIEF DESCRIPTION OF THE DRAWINGS

Other features and advantages of the invention will appear more clearly in the light of the following detailed description with reference to the appended unique FIGURE given by way of example only and diagrammatically showing in an elevational manner an apparatus according to the invention associated to a conveyor for transporting the goblets to be processed.

DESCRIPTION OF THE PREFERRED EMBODIMENTS

According to an embodiment, and referring to the appended unique FIGURE, an apparatus according to the invention is located under the carrying run 2 of a conveyor C with chains or the like passing around toothed wheels 1 and between which are fixed plates or the like comprising openings likely to receive rows of containers or goblets R intended to be processed.

Above the carrying run 2 of conveyor C, successive stations are provided such for example as one station 3 for taking the containers out of piles and other stations which are not shown because they do not belong to the present invention.

The apparatus according to this invention comprises, downstream of the station 3 for taking the containers out of piles, a detecting means, such as a cell 4, located above the carrying run 2 of conveyor C, and a reducer 5 located under the carrying run 2 of conveyor C.

The output shaft 6 of the reducer 5 is connected through a connecting rod-crank system 7 to the body 8 of a cylinder whose rod 9 comprises at its end a pusher 10.

The output shaft of the reducer 5 is also connected through another connecting rod-crank system 7a to pushers constituted by a simple rod 12 the end of which is provided with a pusher 11.

As clearly seen in the Figure, the pushers 10 and 11 are located on both sides of the reducer 5.

More precisely, the rod 12 and its associated pusher 11 are located vertically under the station 3 for taking the containers out of piles, whereas the rod 9 of cylinder 8 and its associated pusher 10 are located under the carrying run 2 of conveyor C, vertically under a storing magazine 13 disposed above the carrying run 2 of conveyor C and downstream of the station 3 for taking the containers out of piles.

The apparatus which has just been described works as follows.

A row of containers or goblets R is taken out of piles from station 3 and received by the pushers 11 which deposit it on the transversal supports solid with the chains of conveyor C.

This being done, the row of goblets R, transported by the conveyor C, pass the cell 4. If the cell detects no defect or lack in this row of containers, the said row is moved towards the following station which is not shown, but which may possibly be a station for filling the containers.

On the contrary, if the cell 4 detects a defect or a lack, this cell will drive the rod 9 out of the cylinder 8, so that the pushers 10 will push from underneath the whole row of containers R to move it, through the carrying run 2 of conveyor C, into the storing magazine 13. This storage can be carried out by any appropriate means, for example through catching of the containers in the magazine 13. The goblets stored in that way can be easily recovered and recycled provided that they are not defective.

Of course, one row of goblets R being eliminated as previously explained, the plate of the conveyor which is to support them will pass the following filling and heat sealing stations, which stations, driven by a robot, will of course not be actuated.

Turning back to the appended unique Figure, it is seen that the rod 12 has a fixed length, whereas the cylinder 8 and its associated rod 9 form in a way an extensible pusher. In other words, if the cell 4 detects no defect or lack, the cylinder 8 will oscillate due to the presence of the connecting rod-crank system 7, but as the rod 9 is retracted, there will be no action on the goblets R, whereas at each rotation of the shaft 6, the rod 12 and its associated pusher 11 will come under a row of containers R at the station 3 to deposit this row of containers on the carrying run 2 of the conveyor.

On the contrary, if a defect or a lack is detected in the row of goblets R once deposited on the conveyor, the rod 9 will come out of the cylinder body 8 so as to push the row of containers R into the magazine 13 under the effect of the rotation of the output shaft 6 of the reducer 5.

Of course, without departing from the scope of the invention, it would be perfectly possible to provide a system differing from the system represented for pushing the containers R into the storing magazine 13.

Therefore, the invention is by no way limited to the described and illustrated embodiment which has been given by way of example only.

On the contrary, the invention comprises all the technical equivalents of the means described as well as their combinations provided that these are carried out according to its spirit.

What is claimed is:

1. An apparatus for automatically eliminating a group of articles, such as for example a group of containers or goblets of which at least one is missing or defective, comprising at least one detecting means, such as for example a cell, located above the articles or containers transported by a conveyor on its carrying run, one magazine for storing the containers which are eliminated, located near the detecting means, and pushers arranged vertically under said magazine and under the articles or containers to push the articles which are transported by the conveyor into the magazine, said pushers constituted by rods of cylinders which are actuatable by said detecting means, wherein the body of said cylinders is connected to the output shaft of a reducer through a connecting rod-crank system, and further comprising a supply station for holding piles of articles at which a group of articles can be released, and wherein the output shaft of the reducer is also connected, through another connecting rod-crank system, to pushing rods which pass through the carrying run of the conveyor to deposit the articles or containers released from the piles at the supply station on the conveyor.

* * * * *